US007667164B2

(12) United States Patent
Bohlender et al.

(10) Patent No.: US 7,667,164 B2
(45) Date of Patent: Feb. 23, 2010

(54) ELECTRIC HEATING DEVICE WITH TOLERANCE PTC HEATING ELEMENT

(75) Inventors: Franz Bohlender, Kandel (DE); Kurt Walz, Hagenbach (DE)

(73) Assignee: Catem GmbH & Co. KG (DE)

( * ) Notice: Subject to any disclaimer, the term of this patent is extended or adjusted under 35 U.S.C. 154(b) by 309 days.

(21) Appl. No.: 11/558,740

(22) Filed: Nov. 10, 2006

(65) Prior Publication Data

US 2007/0114217 A1 May 24, 2007

(30) Foreign Application Priority Data

Nov. 23, 2005 (EP) ..... 05025573

(51) Int. Cl.
*H05B 1/02* (2006.01)

(52) U.S. Cl. ..... 219/505; 219/483; 219/494

(58) Field of Classification Search ..... 219/504, 219/505, 483–486, 501, 494
See application file for complete search history.

(56) References Cited

U.S. PATENT DOCUMENTS 5,471,034 A * 11/1995 Kawate et al. ..... 219/485
5,471,035 A * 11/1995 Holmes ..... 219/505
7,271,369 B2 * 9/2007 Li et al. ..... 219/505
7,343,671 B2 * 3/2008 Hetherton et al. ..... 29/610.1

* cited by examiner

*Primary Examiner*—Mark H Paschall
(74) *Attorney, Agent, or Firm*—Boyle Fredrickson, S.C.

(57) ABSTRACT

For avoiding the selection and storage of PTC heating elements with different departures from rated heating power, additional tolerance PTC heating elements are held ready which uniformly have a lower rated heating power, preferably one half or third of the rated heating power, compared to the standard or primary PTC heating element. By the use of a second standardized heating element, i. e. the tolerance PTC heating element, the storage of a high number of PTC heating elements with different departures can be dispensed with and a cheaper manufacture can be permitted.

14 Claims, 12 Drawing Sheets

Use of standard PTCs with an $R_{25}$ of 2,10 - 2,60 Ohm

| Heating circuits | HK 1 | HK 2 | HK 3 | HK 1+2+3 | |
|---|---|---|---|---|---|
| Heating power tolerance | 245-350 W | 300-420 W | 270-382 W | 900-1050 W | |
| Power | 300-330 W | 350-380 W | 300-330 W | 960-1030 W | |
| Standard PTC | 4 pieces | 4 pieces | 4 pieces | 12 pieces | 14 PTC |
| Tolerance PTC | - | 2 pieces | - | 2 pieces | |

Use of standard PTCs with an $R_{25}$ of 2,10 - 2,60 Ohm

| Heating circuits | HK 1 | HK 2 | HK 3 | HK 1+2+3 | |
|---|---|---|---|---|---|
| Heating power tolerance | 245-350 W | 300-420 W | 270-382 W | 900-1050 W | |
| Power | 300-330 W | 350-380 W | 300-330 W | 960-1030 W | |
| Standard PTC | 4 pieces | 4 pieces | 4 pieces | 12 pieces | 14 PTC |
| Tolerance PTC | - | 2 pieces | - | 2 pieces | |

Use of standard PTCs with an $R_{25}$ of 2,61 - 2,90 Ohm

| Heating circuits | HK 1 | HK 2 | HK 3 | HK 1+2+3 | |
|---|---|---|---|---|---|
| Heating power tolerance | 245-350 W | 300-420 W | 270-382 W | 900-1050 W | |
| Power | 290-310 W | 350-360 W | 300-310 W | 950-1000 W | |
| Standard PTC | 4 pieces | 5 pieces | 4 pieces | 13 pieces | 15 PTC |
| Tolerance PTC | 1 piece | - | 1 piece | 2 pieces | |

Use of standard PTCs with an $R_{25}$ of 2,38 - 2,60 Ohm

| Heating circuits | HK 1 | HK 2 | HK 3 | HK 1+2+3 | |
|---|---|---|---|---|---|
| Heating power tolerance | 245-350 W | 300-420 W | 270-382 W | 900-1050 | |
| Power | 278-320 W | 346-400 W | 284-326 W | 923-1035 W | |
| Standard PTC | 4 pieces | 5 pieces | 4 pieces | 13 pieces | 13 PTC |
| Tolerance PTC | - | - | - | - | |

ELECTRIC HEATING DEVICE WITH TOLERANCE PTC HEATING ELEMENT

BACKGROUND OF THE INVENTION

1. Field of the Invention

The invention relates to an electric heating device, in particular as additional heating for motor vehicles, with PTC heating elements.

2. Description of the Related Art

For the employment in motor vehicles, in particular motor vehicles with optimised consumption engines, where a low amount of thermal energy arises, additional electric heaters for heating the passenger compartment and engine are used. The use of such additional electric heaters in a motor vehicle air conditioning system is schematically represented in FIG. 1. The air conditioning system sucks in outside air 2 via a fan 3. The intake air flows through an evaporator 6, a heat exchanger 7 and the electric heating device 1. Subsequently, the heated air 4 is conducted into the vehicle's passenger compartment via corresponding outflow means.

For an electric additional heating in motor vehicles, PTC heating elements that are in thermally conductive communication with radiator elements for dissipating the heat to the intake air are preferably employed. The overall arrangement of a layered structure of PTC heating elements and radiator elements is generally held in a clamping squeeze in the heating for increasing the efficiency of the heating. By the clamping, high electrical and thermal contacting of the PTC heating elements is achieved.

PTC heating elements are temperature-dependent semiconductor resistors that are heated when current is supplied, the resistance of the heating elements increasing at the same time. Due to the self-regulating properties of the PTC heating elements, an overheating can be securely prevented.

The PTC heating elements employed in electric heaters consist of ceramics and have a flat, generally rectangular structural shape. Current is supplied to the ceramic disks via the large exterior surfaces facing each other. Simultaneously, heat is dissipated via these surfaces. The large surfaces of the PTC heating elements therefore have to have an electrically as well as thermally well connection to the adjacent surfaces. The rated heating power of an electric heating device is the heating power that is to be provided by the heating device under certain standard conditions (e.g. 300 kg/h air flow rate at 0° C.). The actually provided heating power of the heating device results from the sum of the heating powers of the PTC heating elements inserted in the heating device which in turn depends on the characteristic properties of each PTC heating element.

PTC heating elements are normally characterised by the electrical resistance at 25° C. (R25 value) and the temperature at which their resistance suddenly rises (transition temperature). The heating power of a PTC heating element is closely connected with the course of the temperature-resistance characteristic of a PTC heating element, as at a fixed voltage, the heating power only depends on the (temperature-dependent) electrical resistance of the PTC element. Under the above-stated standard conditions, one can therefore also state a "rated heating power" for an individual PTC heating element that is characterised by its rated values for the R25 value and the transition temperature.

For reasons of economy, exclusively PTC heating elements of the same characteristic (R25 value and transition temperature), i. e. of the same "rated heating power", are used, and this not for one single heating or a certain type of heating, but preferably for all electric heaters of one manufacturer.

In general, the PTC heating elements of a heating are distributed to a plurality of separately selectable heat stages. Each of the heat stages is designed to achieve a certain rated heating power and therefore has a corresponding number of PTC heating elements.

Due to differences in the manufacture, the characteristic properties of a PTC heating element, and thus its actually delivered heating power, often significantly depart from the corresponding rated values. The usual departures of the R25 value range between 35% and 50%. The mean value of the departures differs with respect to the charges, i.e. from a closed amount of doped powder and sinter amount.

For taking into consideration the departures of the PTC heating elements from their rated heating power due to differences in the manufacture, the actual heating power of a heating/a heat stage can vary within a given tolerance range. In the worst case, in a heating/heat stage, only PTC elements having the same amount of departures from their rated heating power are employed. The individual departures can summarize in this case, such that the admissible tolerance limits of the heating/heat stage are exceeded or not achieved.

In order to avoid exceeding or falling below the tolerance limits, PTC heating elements with compensating departures are conventionally combined in one heating/heat stage. By means of such a combination of opposed departures, PTC heating elements can be used the departures of which are relatively high compared to the tolerances of the heating/heat stage. A disadvantage of this approach, however, is the selection and storage effort required for it. That means, first the individual departure of single PTC heating elements has to be established. Subsequently, a sufficient piece number of PTC heating elements of varying departures have to be stored for a continual production process.

OBJECT OF THE INVENTION

It is therefore an object of the invention to provide an electric heating with an improved structure and a corresponding manufacturing process, so that in a continuous manufacturing process, for example a chain production, expensive and elaborate storing of large piece numbers of PTC heating elements, classified with respect to their departures, is eliminated.

This object is achieved with the features of the independent claims.

It is a particular approach of the present invention that in the production of an electric heating, in addition to primary PTC heating elements with a fixed standard rated heating power, further "tolerance" PTC heating elements with a second predetermined rated heating power are employed. The tolerance PTC heating element preferably has a standard power rating lower than that of the primary heating elements. Due to the exclusive use of PTC heating elements with only two standardized rated heating powers, the large-scale manufacture of electric heaters can be clearly simplified. Preclassification and storage of PTC heating elements with certain departures and in sufficient piece number are eliminated.

According to a first aspect, the invention relates to an additional electric heating for a motor vehicle. The heating comprises a plurality of heat stages with at least one PTC heating element each, the PTC heating elements having the same first rated heating power. Moreover, the heating comprises a plurality of radiator elements for dissipating the generated heat to a medium flowing through the radiator elements. At least one of the heat stages contains a tolerance PTC heating element with a second rated heating power for correcting departures of the heating power of the at least one PTC heating element from the first rated heating power, which departures are due to differences in the manufacture. In this case, the second rated heating power is lower than the first rated heating power.

According to a second aspect, the invention relates to a manufacturing process for an additional electric heating for a motor vehicle. In the manufacturing process, the electric heating is assembled to form a layered structure of a plurality of levels of PTC heating elements and radiator elements for dissipating the heat to a medium flowing through the radiator elements. Each of the levels with PTC heating elements has at least one primary PTC heating element. All primary PTC heating elements possess the same rated heating power. The number of primary PTC heating elements of one level provided on the basis of the first rated heating power of the PTC heating elements is corrected by inserting a tolerance PTC heating element with a second rated heating power or by replacing one primary PTC heating element with the first rated heating power by a tolerance PTC heating element with the second rated heating power. In this manner, departures of the heating power of the at least one PTC heating element from the first rated heating power, which departures are due to differences in manufacture, are compensated in one level. In this case, the second rated heating power is lower than the first rated heating power.

The rated heating power of the tolerance PTC heating element clearly differs from the rated heating power of the standard or primary PTC heating elements. Advantageously, the rated heating power of the tolerance PTC heating element is a fraction of the first rated heating power of the standard or primary PTC heating element, preferably one half, third or quarter of the first rated heating power.

The dimensions of the tolerance PTC heating element preferably correspond to those of the standard or primary PTC heating element. This makes it particularly easy to integrate the tolerance PTC heating element into the existing structure and production process of a heating. Inter alia, the same positioning means which are also already held ready for standard or primary PTC heating elements can be used. The tolerance PTC heating element here advantageously has the same thickness and in particular also the same length and/or width as the standard or primary PTC heating element.

The rated heating power of the standard PTC heating elements is preferably between 50 Watts and 100 Watts, preferably 70 Watts.

The electric heating preferably consists of a layered structure of PTC heating elements and radiator elements.

Preferably, the PTC heating elements of one level are held in a positioning frame. Here, each positioning frame has, according to a particular aspect of the invention, only openings for the PTC heating elements actually inserted. To this end, preferably positioning frames with varying numbers of openings for PTC heating elements are held ready, and the respective appropriate positioning frame is selected during production.

According to another preferred embodiment, a fixed number of spaces for PTC heating elements is provided in the layered structure in one level. During manufacture, spaces not needed for PTC heating elements are filled with dummy elements. With such a structure, the number of PTC heating elements per level can be easily varied, and in particular according to the invention, a tolerance PTC heating element can be added.

Preferably, the additional electric heating is designed for low-voltage operation that means for onboard supply voltages of less than approx. 120 Volts.

Other advantageous embodiments of the invention are the subject matter of the claims.

Below, the present invention is illustrated with reference to preferred embodiments in connection with the enclosed drawings. The drawings show in detail:

DETAILED DESCRIPTION OF THE PREFERRED EMBODIMENT

The present invention facilitates the manufacturing process for a series production of electric heating devices by the use of a tolerance PTC heating element. The tolerance PTC heating element compensates departures of the actual heating power of a heating/heat stage and thus avoids the conventional storage of PTC heating elements with an actual heating power that departs from the rated heating power.

The employment of a tolerance PTC heating element according to the invention is independent of the structural shape of the heating device. In connection with FIGS. 2 to 16, by way of example the structure of different heating devices is described. Common to the heating devices is a heat register with a layered structure of PTC heating elements and radiator elements. The application of the present invention, however, is not restricted to the embodiments given by way of example.

Figure 1:
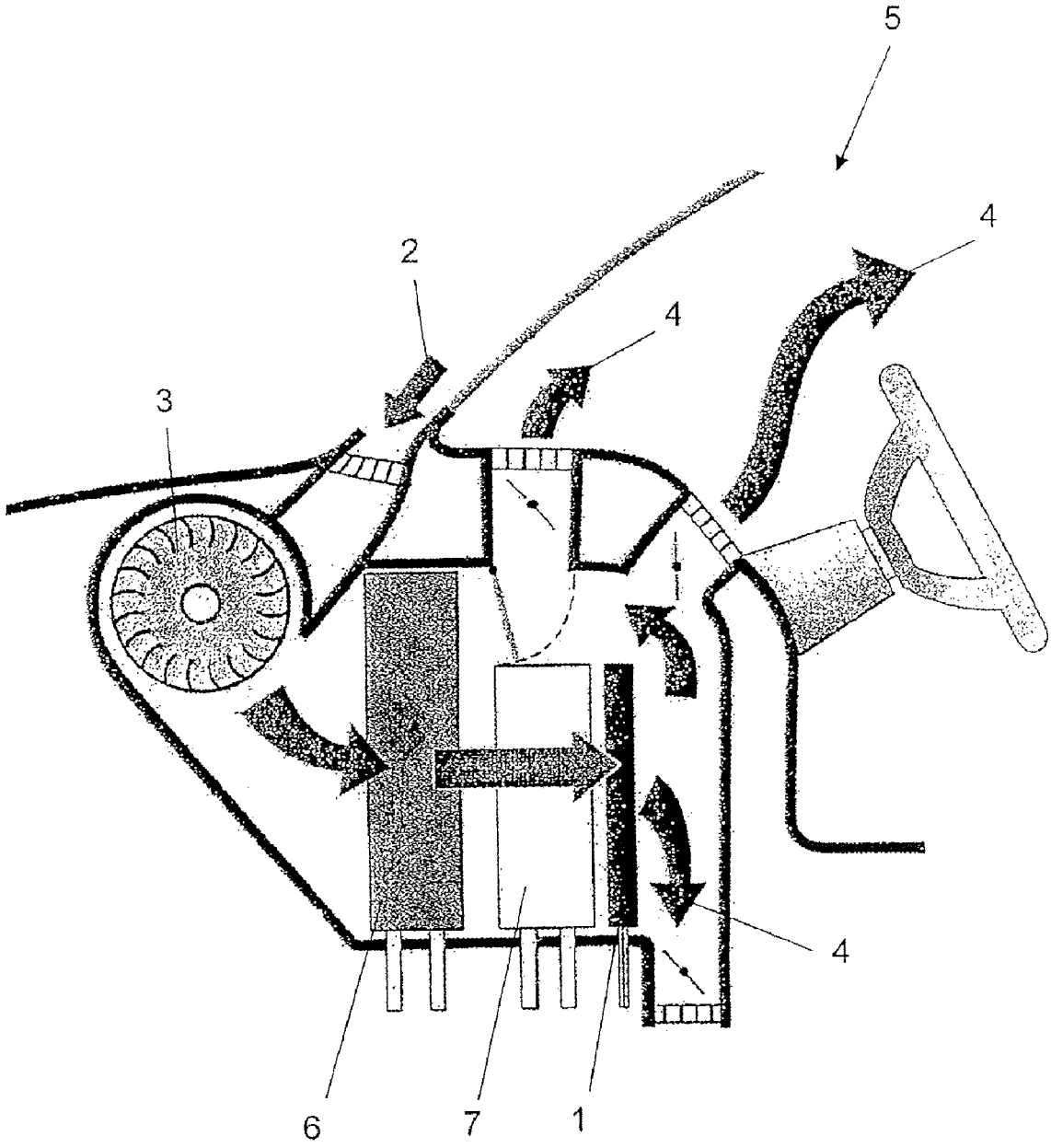
FIG. 1 a schematic representation of an air conditioning system for a motor vehicle with an electric heating device, FIG. 2 a side view of a first structural shape of an electric heating device, FIG. 3 a plan view onto an electric heating device according to the first structural shape, FIG. 4 a positioning frame for positioning PTC heating elements in the electric heating device according to the first structural shape, FIG. 5 a perspective view of a radiator element with standard PTC heating elements, dummy elements and a tolerance PTC heating element, FIG. 6 a perspective view of a partially equipped housing shell of an electric heating device according to a second structural shape, FIG. 7 a further perspective view of a partially equipped housing shell of the housing of the heating device according to the second structural shape, FIG. 8 a perspective view of the electric heating device according to the second structural shape assembled from two housing shells, FIG. 9 a perspective view of the electric heating device according to the second structural shape with a partially inserted spring element, FIG. 10 a perspective view of the heating device of the second structural shape with a different structure, FIG. 11 a further perspective view of the structure of the heating device according to FIG. 10, FIG. 12 a perspective partial view of the heating device according to FIG. 10, FIG. 13 a perspective view of a further different structure of the second structural shape of an electric heating device, FIG. 14 a variant of equipment of the electric heating device of FIG. 13 with standard PTC heating elements and tolerance PTC elements, FIG. 15 another variant of equipment of the electric heating device of FIG. 13 with standard PTC heating elements and tolerance PTC elements, and FIG. 16 another variant of equipment of the electric heating device of FIG. 13 with standard PTC heating elements.
Figure 2:
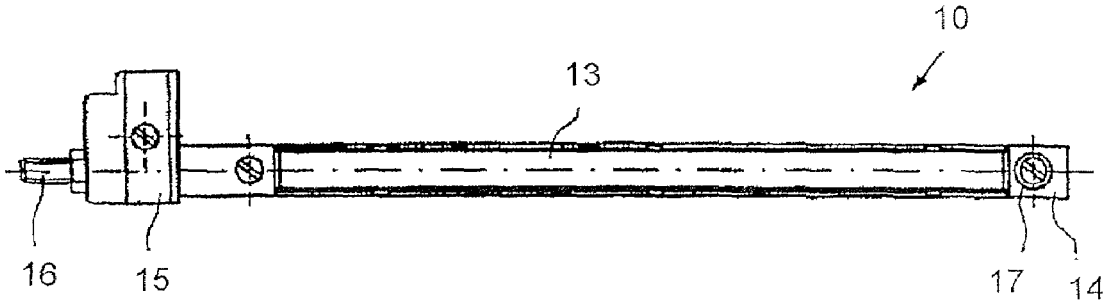
Figure 3:
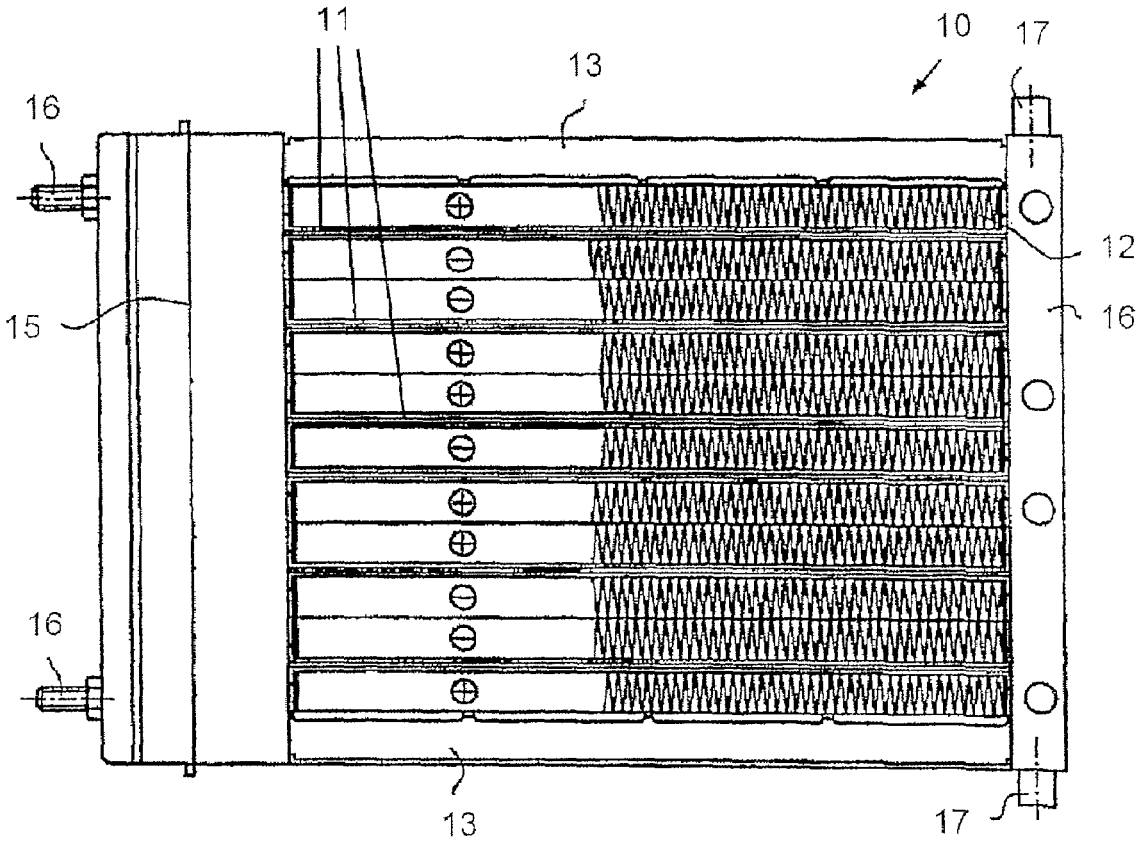

A first embodiment of an electric heating device that is in particular suited for the employment in motor vehicles is represented in FIGS. 2 and 3. FIG. 2 shows a side view, FIG. 3 a plan view of the electric heating device of the first embodiment. The heating device 10 has a heat register of a plurality of levels 11 of heating elements and radiator elements 12 arranged in a layered structure. The heating elements are each arranged adjacent to the radiator elements 12 for dissipating the generated heat to a medium flowing through the radiator elements 12.

The heat register shown in FIGS. 2 and 3 is held in a frame consisting of longitudinal beams 13 arranged at opposite sides and side beams 14 and 15 arranged vertically to them. The frame beams are preferably made of metal or plastics.

In the embodiment which is shown in FIGS. 2 and 3, the side beam 15 is formed as box opened at one side. The opening of this box-like side beam is situated on the side opposite the heat register. In this box, a control device can be inserted which regulates the heat dissipation of the individual levels of PTC heating elements (heat stages). The opened side of the side beam 15 is closed with a lid that can be put or clipped on after the control device has been inserted.

The power distributed to the individual heat stages by the control device is supplied to the heating by means of connecting bolts 16. In addition, the side beam 15 is equipped with a plug base for external activation. Preferably, external control signals are supplied via a motor vehicle bus.

Figure 4:
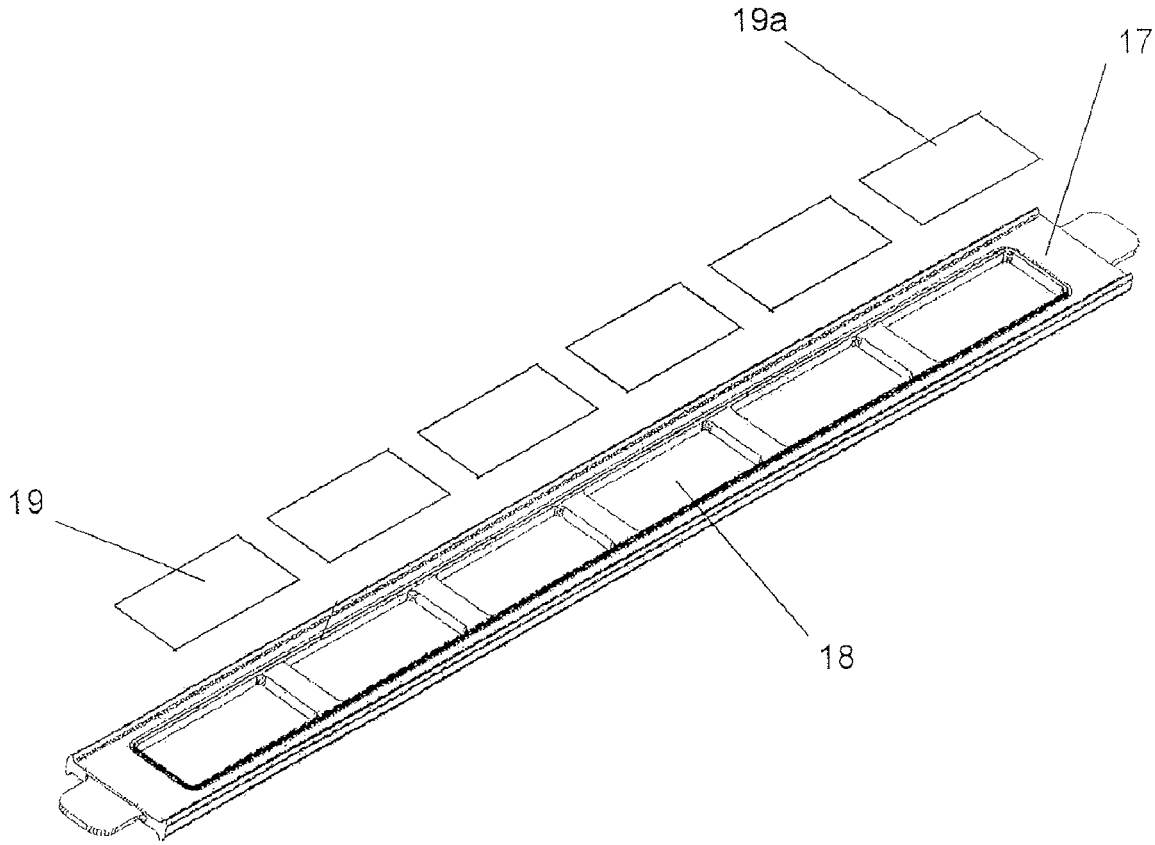

In the individual levels 11 with PTC heating elements, these are held by means of a positioning means. In FIG. 4, a positioning frame 17 is depicted for this purpose. The positioning frame 17 has a number of openings 18 corresponding to the number of PTC elements 19 provided for the corresponding heating level 11. For the production process, therefore positioning frames 17 with varying numbers of openings 18 are held ready.

The correction of the actual heating power of a heating level/heat stage is effected according to the invention by employing a tolerance PTC heating element 19*a*. If the actual heating power of a heating/heat stage is clearly lower than the rated heating power, by means of an additional inserted tolerance PTC heating element 19*a*, the difference can be compensated such that the total heating power is again in the pre-determined tolerance range. For doing so, a positioning frame 17 with an additional opening 18 for the tolerance PTC heating element 19*a* is used. In case of an actual heating power that is too high compared to the rated heating power, according to the invention one of the PTC heating elements 19 is replaced by the tolerance PTC heating element 19*a*. An exchange of the positioning frame 17 is not necessary if the tolerance PTC heating element 19*a* essentially has the same dimensions as the PTC heating element 19.

It is a particular advantage in the embodiment of the tolerance PTC heating element 19*a* with essentially the same dimensions as the PTC heating element 19 that the conventional positioning frame 17 can still be used. Additional positioning frames with a particular design of the openings for a tolerance PTC heating element are then not necessary. Alternatively, however, tolerance PTC heating elements 19*a* with another structural shape than that of the PTC heating elements 19 can also be used. In this case, however, a corresponding adjustment of the positioning frame 17 and the additional storage of positioning frames for the employment of the tolerance PTC heating elements are necessary.

Figure 5:
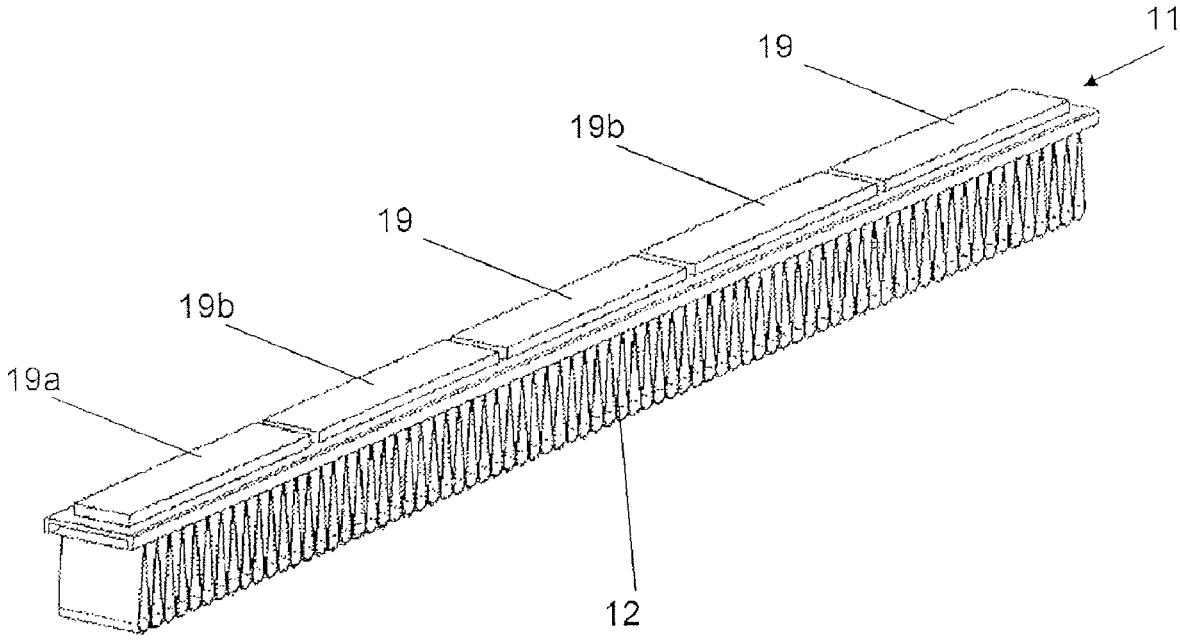

An alternative embodiment of a heating device that can do without a positioning frame is shown in FIG. 5. Altogether, in one level 11 of this example, five components having the same dimensions are used each. Depending on the desired rated heating power, in this example two standard PTC heating elements 19 are inserted at the central and at a marginal position and two dummy elements 19*b* are inserted adjacent to the central position. Moreover, a tolerance PTC heating element 19*a* is employed at the other marginal position. If no tolerance PTC heating element is required, depending on the design of the heat stage, another dummy element or a standard PTC heating element is inserted instead. By the use of components having the same dimensions, no adjustment of the equipment to the employment of the tolerance PTC heating element according to the invention is necessary, but the tolerance PTC heating element simply replaces either a standard PTC heating element or one of the dummy elements.

The present invention uses only two types of PTC heating elements, namely a standard PTC heating element 19 with a fixed predetermined standard rated heating power, and additionally a tolerance PTC heating element 19*a* with a rated heating power departing therefrom, which is, however, also predetermined. The rated heating power of the standard PTC heating element 19 is preferably in the range of between 50 and 100 Watts, preferably in the order of about 70 Watts.

The tolerance PTC heating element 19*a* preferably comprises a rated heating power with a fraction of the rated heating power of the standard PTC heating element 19. In particular, the tolerance PTC heating element 19*a* comprises a rated heating power approximately corresponding to one half or a third of the rated heating power of the standard PTC heating element 19, preferably approx. 25 Watts. Depending on the mean amount of the departures of the actual heating power of the standard PTC heating elements 19 and the tolerance of the heating/heat stage to be observed, for the tolerance PTC heating element 19*a*, a higher or lower rated heating power can also be determined. It is essential that in the production process a tolerance PTC heating element is inserted which only has one single rated heating power different from the rated heating power of the standard PTC heating elements 19. This can keep the additional costs, time and effort particularly low.

In order to achieve a clearly lower heating power of the tolerance PTC heating elements with the same applied voltage, the tolerance PTC heating elements differ from the standard PTC heating elements with respect to their R25 value as well as to their transition temperature. This is achieved by the manufacturer by the doping of the sinter starting material being changed with respect to the standard PTC heating elements. The different doping is in particular necessary if the tolerance and standard PTC heating elements should have the same geometrical dimensions.

Per heat stage, maximally only one single tolerance PTC heating element 19*a* is inserted, independent of the number of standard PTC heating elements 19. Each level 11 with PTC heating elements in FIG. 3 can represent a separate heat stage. However, several levels 11 can also be combined to form one heat stage. In this case, equally maximally only one single tolerance PTC heating element per heat stage is inserted for a plurality of levels 11 with PTC heating elements, namely the levels 11 of the heat stage.

Below, the invention will be described in connection with other embodiments of the heating device. In FIGS. 6 to 9, the manufacture of a heating 20 is shown which is assembled of two plastic shells 21*a*, 21*b*. The particular advantage of this structure is that during production, first one of the housing shells can be equipped in a simple manner, and subsequently, the heating 20 is completed by placing the second shell.

Figure 6:
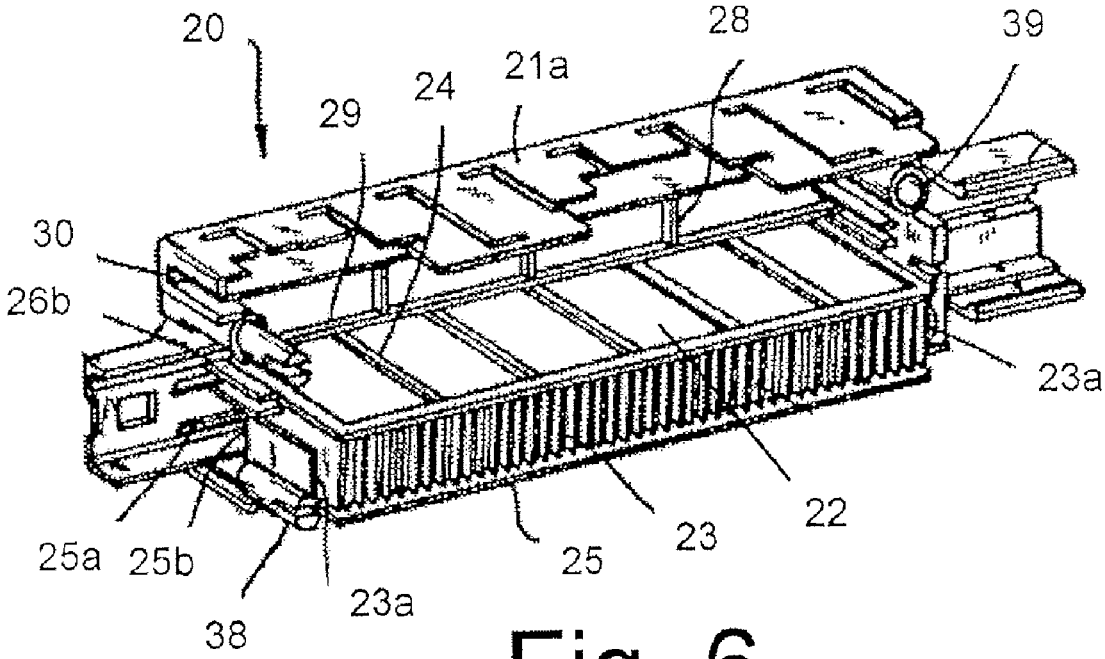

A first step of the manufacturing process is shown in FIG. 6 in a perspective view. A contact sheet 25, a radiator element 23 and adjacent thereto PTC heating elements 22 are inserted in the shell 21*a*. For facilitating the assembly, guide rails or positioning means each are provided for all components. In particular, the position of the contact plate 25 is defined via the guide 25*b* with a contact pin 25*a* during insertion (the same applies for the contact plate 26 in FIG. 7). The radiator elements 23 are preferably designed in the form of corrugated elements. On one side, the corrugated element is provided with a contact plate. For the ends of the contact plate of the corrugated element 23, inside the housing shells guides 23*a* are provided laterally. As these guides exclusively serve the facilitation of assembly, one can dispense with them in an alternative embodiment.

For facilitating the insertion of the PTC heating elements 22 and for insulating the heating elements 22 from one another when they are mounted, positioning means 24 are provided in the shell. These positioning means can be a positioning frame as is principally correspondingly described for a differently designed heating in connection with FIG. 5. Alternatively, the positioning means can be fixed to a longitudinal strut 29 of the lateral front sides of the housing in the form of projections and project into the housing.

Figure 7:
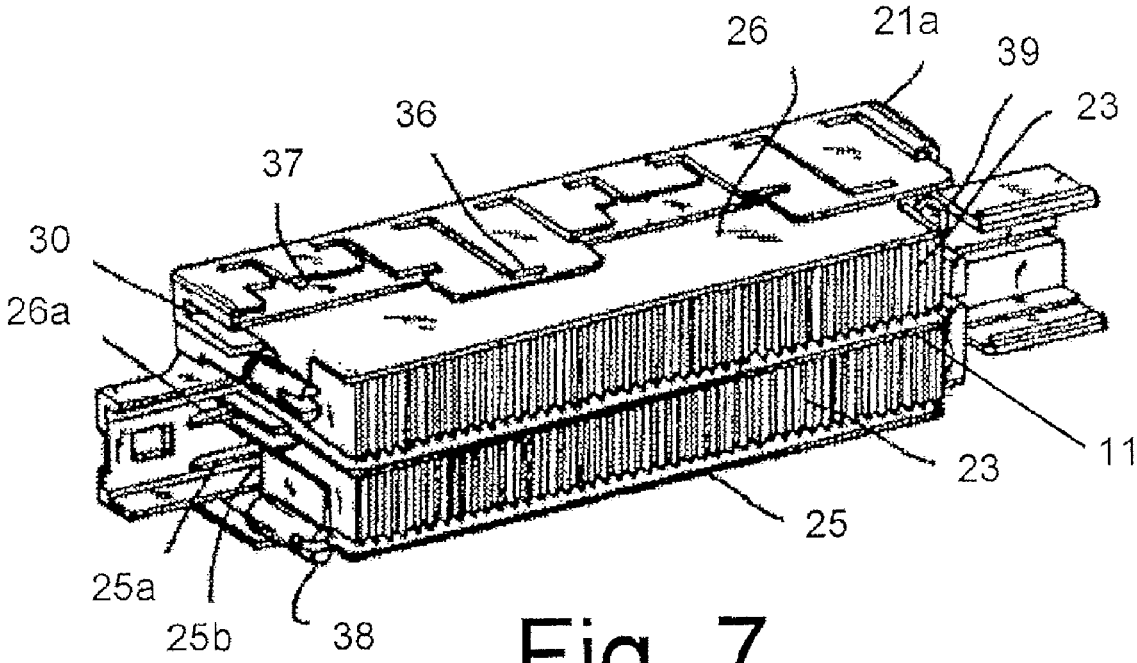

As is shown in FIG. 7, above the PTC heating elements 22, in turn one radiator element 23 and one contact plate 26 with a plug contact 26*a* are provided—corresponding to the structure shown in FIG. 6.

The second housing shell 21*b* can be placed on the first housing shell 21*a* equipped in this manner. Both housing shells 21*a*, 21*b* are preferably designed such that their separating line extends approximately in the middle between the two oblong housing front sides with the passages for the air flowing therethrough.

The assembly of the two housing shells can particularly be facilitated by providing both shells with catch pins 38 and corresponding holes 39 in the respective opposite shell. When the shells are put together, both shells are locked with each other, so that the second shell is mechanically fixed on the first shell 21*a*.

In FIG. 6, a plurality of spaces for PTC heating elements 22 is depicted. If a positioning frame is used, the number of openings can be variably adapted to the actual demand. Preferably, however, the corresponding positions for PTC heating elements are predetermined by the projections provided at the longitudinal rib 29.

If the number of actually inserted PTC heating elements 22 is lower than that of the provided number of spaces, the non-occupied spaces are filled with dummy elements. In this manner, the occupation can be adapted to the actually required number of PTC heating elements. Correspondingly, an additional tolerance PTC heating element is inserted instead of a dummy element, if required.

Figure 8:
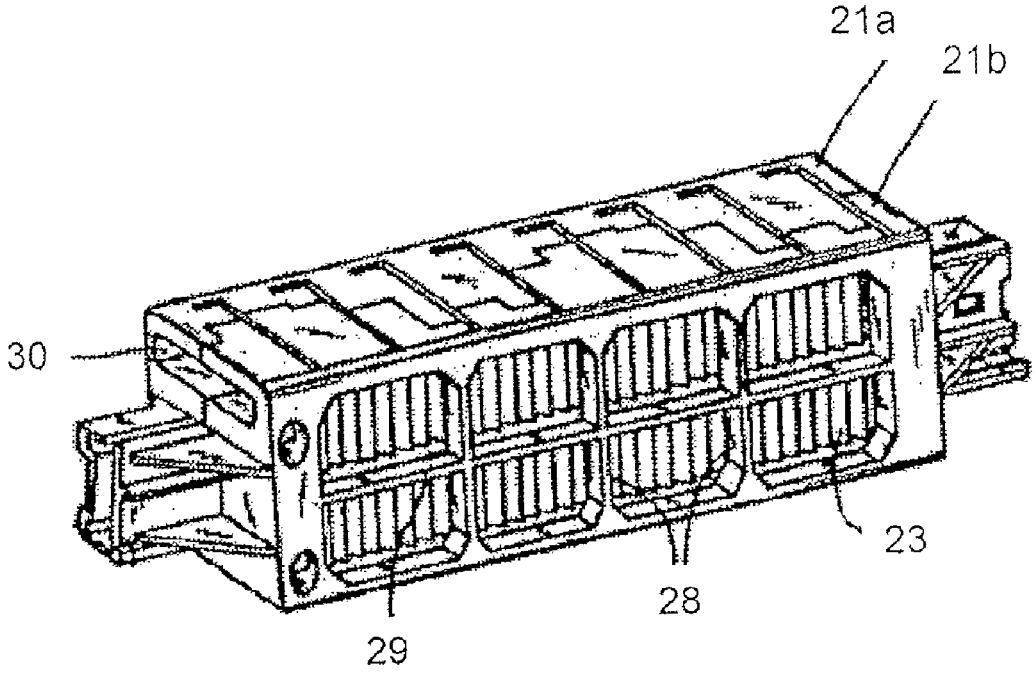
Figure 9:
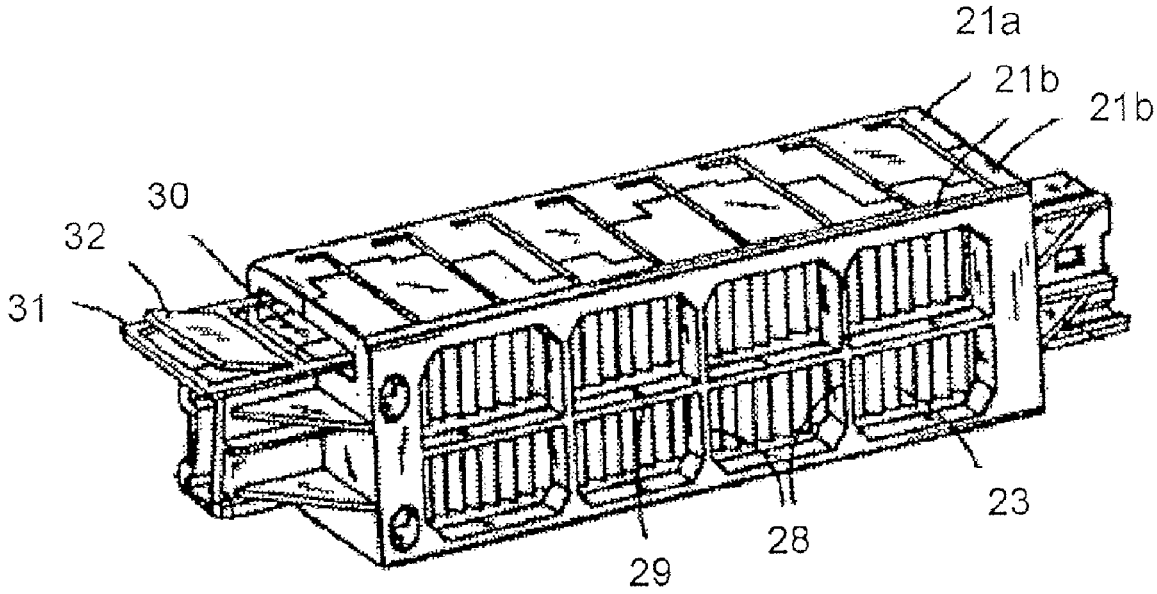
Figure 10:
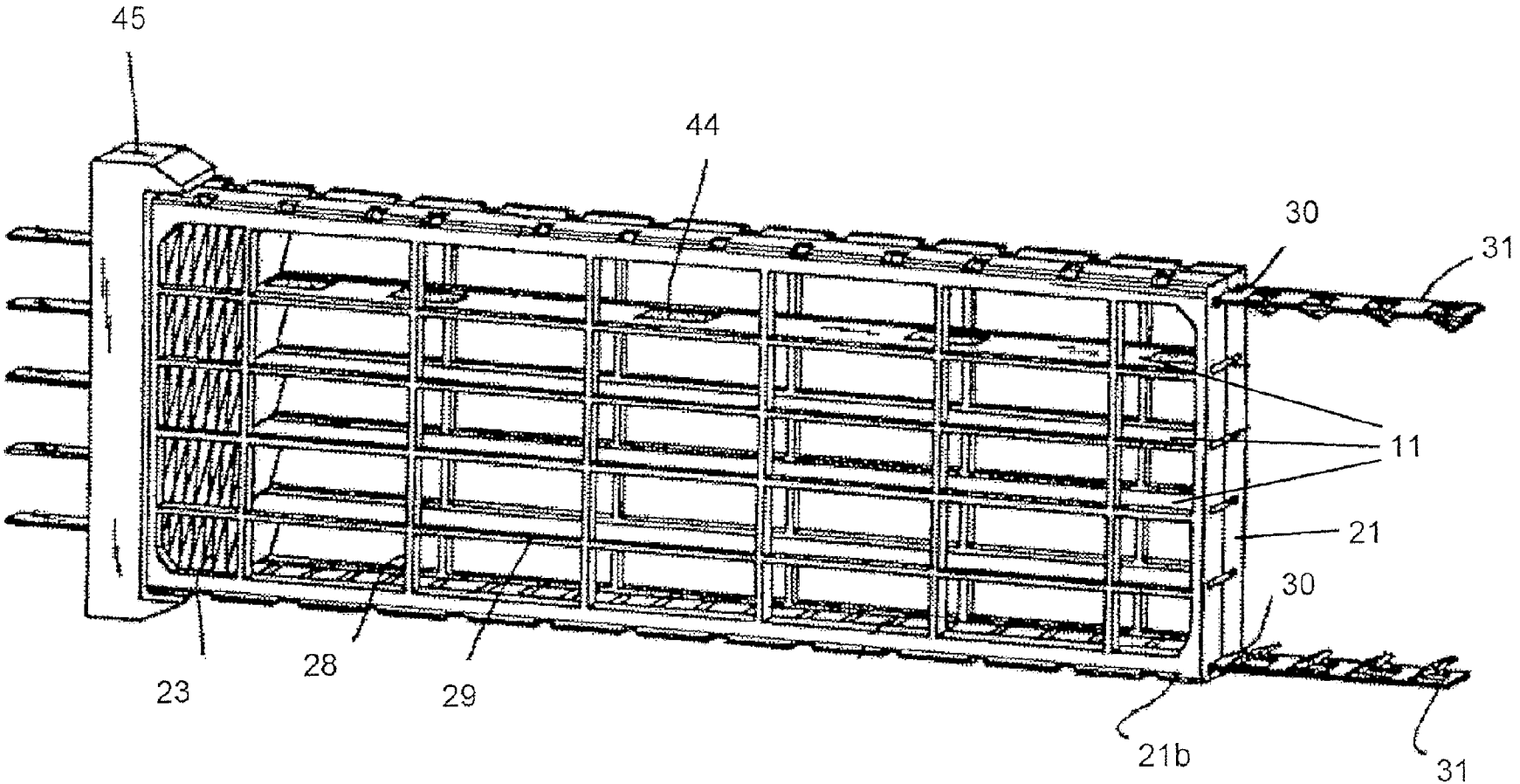

The heating device assembled from two housing shells is represented in FIG. 8. Each of the housing halves 21*a*, 21*b* comprises openings at the oblong housing front sides for the air flowing therethrough. At the central strut 29, according to a preferred embodiment, the positioning means projecting into the housing are attached.

For increasing the efficiency of heat generation by the PTC heating elements, the layered structure is held in a clamping squeeze inside the housing. This clamping is effected by an additional spring element 31. The spring element is inserted into a lateral opening 30 of the housing after the two housing shells 21*a*, 21*b* have been assembled. Preferably, the spring element 31 is inserted between the housing inner side and the layered structure at least at the top or bottom side of the housing. Such a spring element, however, can also be inserted at any other site within the layered structure. For increasing the clamping squeeze, a plurality of spring elements 31 can be inserted in one heating.

For the housing to be able to absorb the clamping powers without the housing being deformed, the oblong housing front sides are mechanically reinforced. By a mechanical reinforcement of the housing front sides by cross struts 28 and longitudinal struts 29, the housing can absorb sufficiently high clamping powers without any bending or deformation.

The cross struts 28 and the one or more longitudinal struts 29 preferably have the shape of a grid structure. With such a grid structure, the struts themselves can be kept particularly thin in order to avoid an impediment of the air flow rate.

For absorbing the clamping powers, additionally the top and bottom sides of the housing shells 21*a*, 21*b* are mechanically reinforced. To this end, on the top and bottom sides of each shell, projections 36 and indentations 37 are provided. The projections and indentations are arranged oppositely in the two housing shells. When the housing shells are assembled, they engage and in this manner reinforce the mechanical stability of the top and bottom sides.

As the housing is only able to absorb high clamping powers without deformation after it has been assembled, the spring element 31 is only inserted into the corresponding opening 30 after the assembly, the opening preferably being provided at the narrow sides of the housing. The opening 30 is formed by corresponding recesses in the housing shells when these are assembled.

The spring element 31 has a plurality of individual spring segments 32 generating the clamping pressure.

In FIGS. 10 to 13, variants of the structure of an electric heating device described in connection with FIGS. 6 to 9 are shown. These heating devices are narrower compared to the embodiment shown in FIGS. 6 to 9, however, they have a larger cross-sectional area for a higher air flow rate. To this end, the represented heating device has PTC heating elements in a plurality of levels 11. In contrast to the embodiment according to FIG. 6, the rectangular PTC heating elements are oriented with their longitudinal sides in parallel to the oblong housing front sides. In particular, the heating device has a higher number of cross struts 28 due to the longer longitudinal extension. In addition, the use of two spring elements 31 is depicted, which are inserted at the upper and lower ends, respectively, on the narrow side of the housing.

Figure 11:
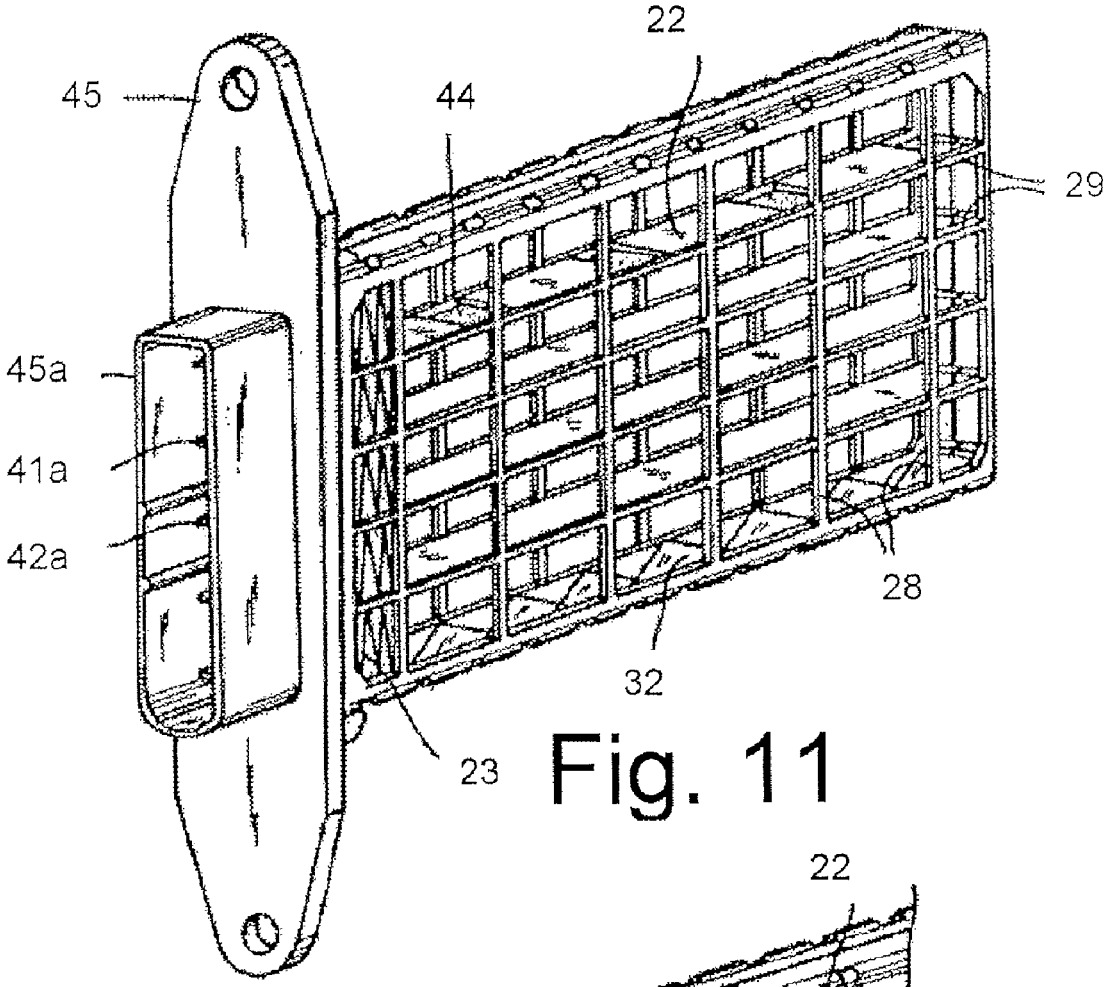
Figure 12:
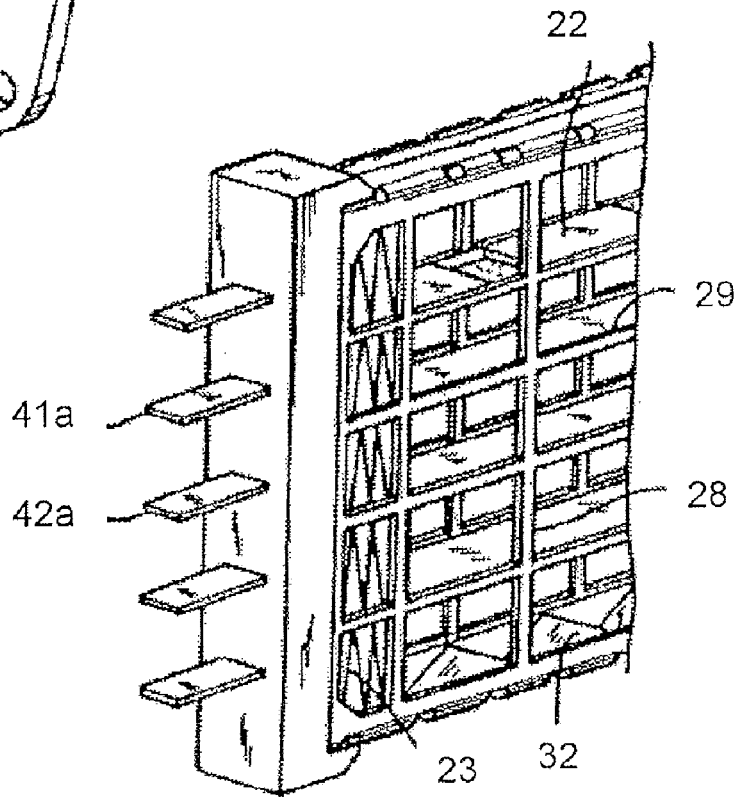

For mechanically fixing the device in a motor vehicle and for providing electric contact, the heating registers are provided with a plug attachment 45 on the side where the electric contact studs 41*a*, 42*a* project. The plug attachment 45 which is shown in FIG. 11 and FIG. 13 consists of a mechanical stop with attachment holes and a plug shoe 45*a* surrounding the contact studs 41*a*, 22*a*.

Preferably, the levels 11 with the PTC heating elements 22 are sealed with silicone seals at the longitudinal struts 29 to prevent penetration of moisture and soil particles. For facilitating the mounting of the seals during manufacture, the silicone seals preferably have a shape corresponding to the grid structure of the struts. This particularly facilitates production as the seals can be inserted as a whole in each case.

Figure 13:
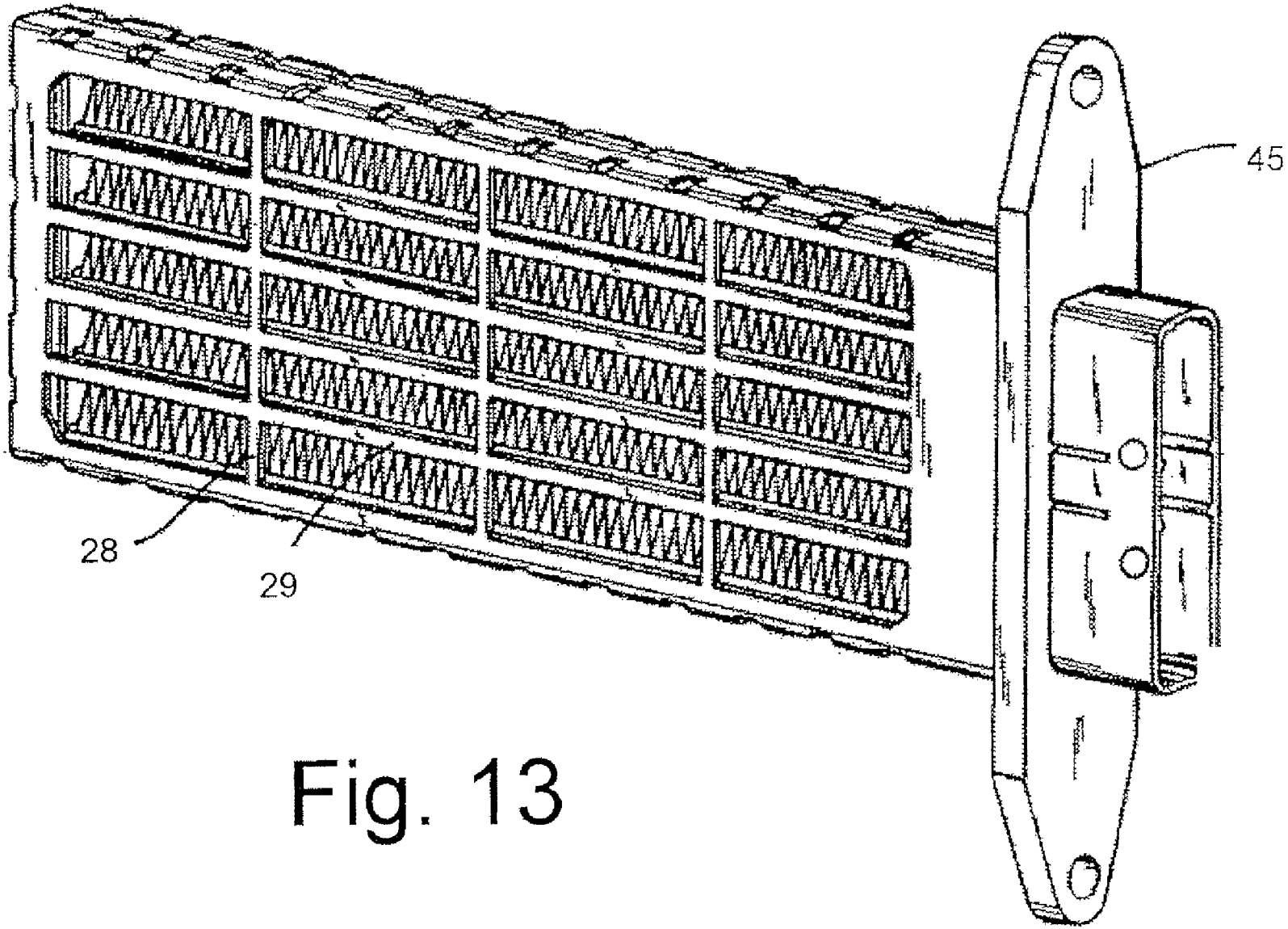
Figure 14:
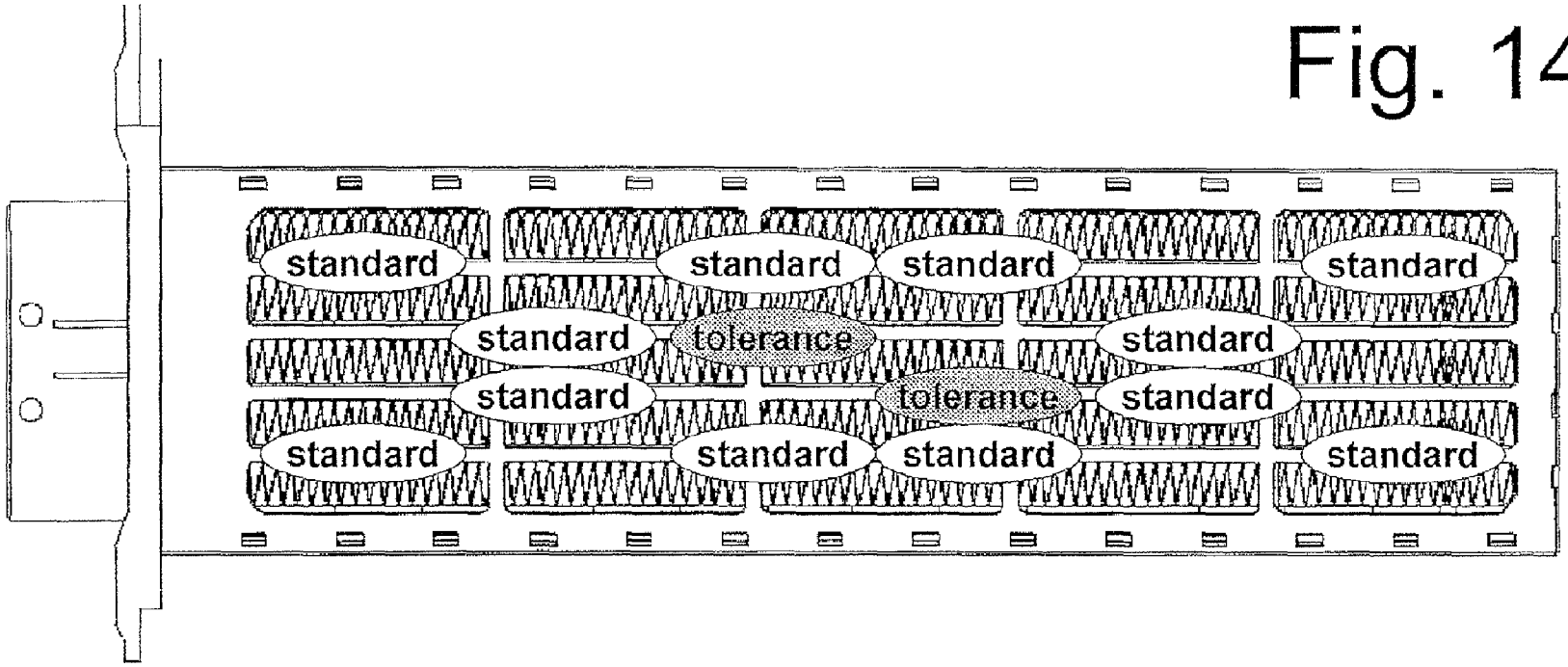
Figure 15:
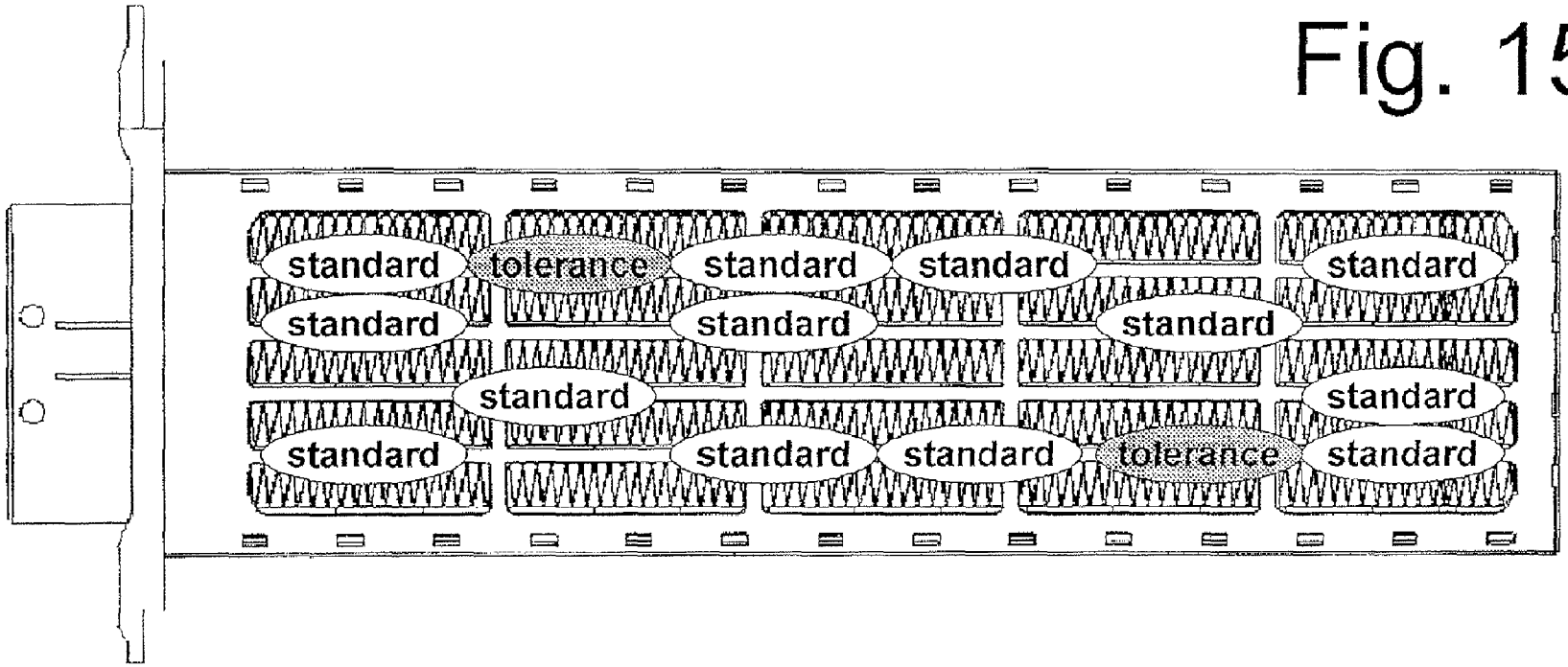
Figure 16:
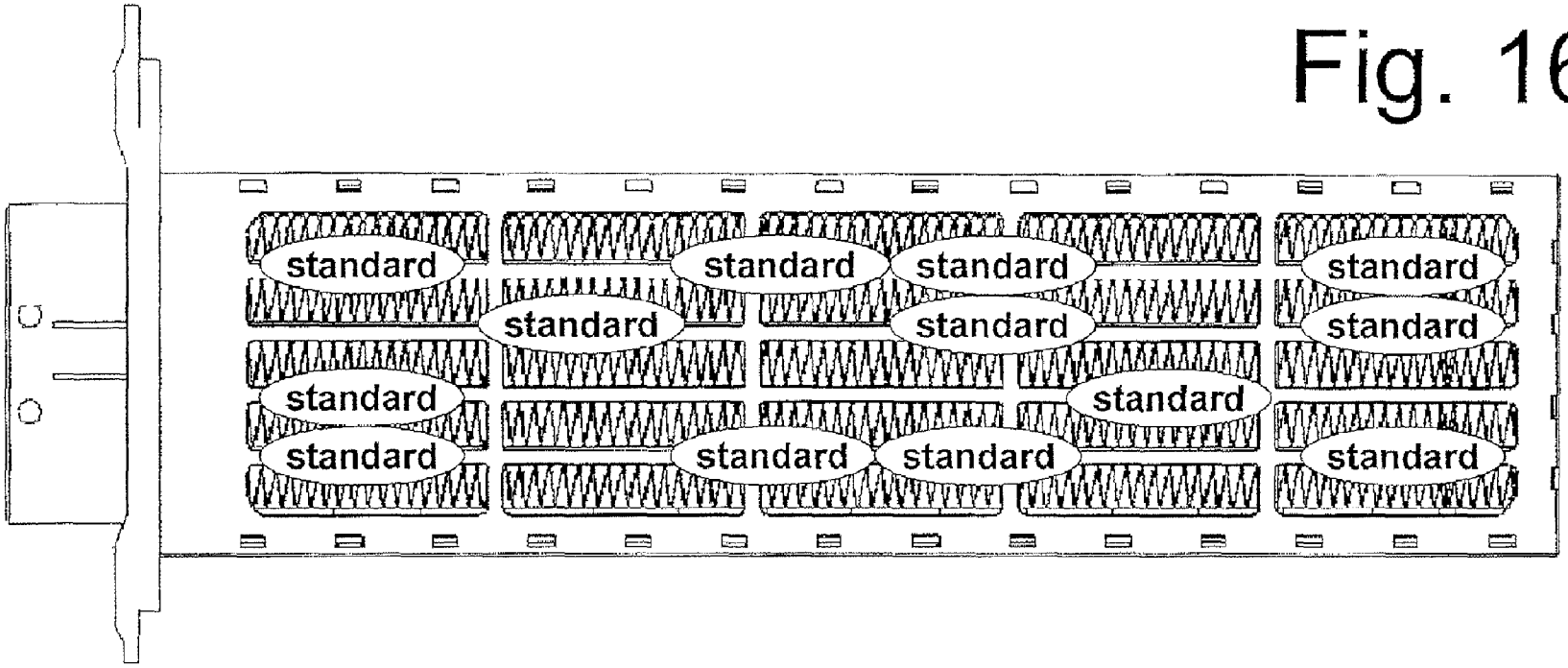

FIGS. 14-16 show variants of equipment of the electric heating device shown in FIG. 13 with standard and tolerance PTC heating elements depending on the actual heating power of the inserted standard PTC heating elements. For the decision of which variant of equipment is to be selected, the R25 value, i. e. the electrical resistance at 25° C., of the inserted standard PTC elements is consulted. A lower R25 value means that even at high temperatures, the resistance is lower and therefore a higher heating power is achieved. Vice-versa, one can assume a lower heating power in case of a high R25 value.

The heating devices shown in FIGS. 14-16 comprise three separately selectable heating circuits (HK 1-HK 3) for each of which separate heating power tolerances have to be observed. Moreover, the heating power of the combination of the heating circuits (HK 1+2+3) also has to be within the predetermined tolerance values.

The tables given for FIGS. 14-16 contain these tolerance limits and the number of standard and tolerance PTC heating elements inserted for each heating circuit as well as the range of the actual heating power achieved with them. The graphic at the top of the Figures moreover shows the spatial arrangement of the standard and tolerance PTC heating elements in the heating device. The uppermost layer of the PTC heating elements here corresponds to the heating circuit 1, the two central layers to the heating circuit 2, and the lowermost layer to the heating circuit 3.

FIG. 14 shows the equipment of the heating device with standard PTC heating elements with an R25 value of 2.10-2.60 Ohm and a transition temperature of approx. 160° C. In the first heating circuit, four standard PTC heating elements are used which together provide a heating power of 300-330 W, i. e. approx. 75 W per standard PTC heating element. This heating power is within the predetermined tolerance range of 245-350 W.

For the second heating circuit, the heating power tolerance range is 300-420W, so that here four standard PTC heating elements and in addition two tolerance PTC heating elements are used. The tolerance PTC heating elements differ from the standard PTC elements by a clearly higher R25 value of approx. 8 Ohm as well as a clearly lower transition temperature of 130-150° C. and thus by an essentially lower rated heating power of approx. 25 W each. Due to the small contribution to the total heating power, the tolerances due to differences in production can be neglected with the tolerance PTC heating elements. The actual heating power achieved by this combination is in the range of 350-380 W.

For the third heating circuit, the heating power tolerance range is 270-382 W, so that here, as in the first heating circuit, four standard PTC heating elements are used which together provide the required heating power of 300-330 W.

That means that altogether the heating device contains twelve standard and two tolerance PTC heating elements which together provide a heating power of 960-1030 W and thus observe the tolerance limits of 900-1050 W.

FIG. 15 shows the variant of equipment that is to be selected for standard PTC heating elements with an R25 value of between 2.61 and 2.90 Ohm. Due to the higher R25 value as compared to FIG. 14, these standard PTC heating elements have a lower actual heating power of approx. 70 W each, so that another equipment has to be selected in order to be able to meet the tolerance demands on the total heating power. As can be taken from the table of FIG. 15, therefore four standard and one tolerance PTC heating elements are used in each of the heating circuits 1 and 3. The heating circuit 2 contains five standard PTC heating elements, so that the total heating power is in the range of 950-1000 W.

FIG. 16 finally shows a variant of equipment for standard PTC heating elements with a more exacting tolerance range of the R25 values of 2.38-2.60 Ohm. Compared to FIG. 14, the lower limit of the R25 tolerance range is higher, so that the actual heating power of an individual standard PTC heating element is lower in average. Different from the equipment shown in FIG. 14, the two tolerance PTC heating elements with a heating power of together approx. 50 W are therefore replaced by a standard PTC heating element with a heating power of approx. 70 W in order to be able to meet the tolerance demands.

Summarizing, the present invention permits a significant facilitation of the manufacture efforts for electric heating devices with PTC heating elements of uniform heating power. In order to be able to compensate the tolerances with respect to the rated heating power due to differences in manufacture, conventionally high numbers of PTC heating elements with opposed departure are stored. An appropriate combination of the departures also permits to observe exacting tolerances of the total actual heating power of a heating/heat stage. For avoiding the selection and storage of different departures, according to the invention additional tolerance PTC heating elements are held ready which uniformly have a lower rated heating power, preferably one half or third of the rated heating power, compared to the standard PTC heating element. By using a second standardized heating element, i. e. the tolerance PTC heating element, the storage of a high number of PTC heating elements with different departures can be dispensed with, and a cheaper manufacture can be permitted.

We claim:

1. An auxiliary electric heater for a motor vehicle, comprising:

a plurality of heat stages with at least one PTC heating element each, all of the PTC heating elements having the same, first rated heating power, and a plurality of radiator elements for dissipating the generated heat to a medium flowing through the radiator elements, wherein at least one of the heat stages contains a tolerance PTC heating element with a second rated heating power for correcting departures of the heating power of the at least one PTC heating element from the first rated heating power due to differences in manufacture, the second rated heating power being lower than the first rated heating power, wherein the PTC heating elements are arranged in levels in a layered structure of PTC heating elements and radiator elements, and wherein, in each of the levels, a pre-determined number of spaces for PTC heating elements is provided, and in one level for PTC heating elements with the first and the second rated heating powers not required, spaces are filled with dummy elements.

2. The electric heater according to claim 1, wherein the second rated heating power is a fraction of the first rated heating power.

3. The electric heater according to claim 1, wherein the second rated heating power is one of one half, one third, and one quarter of the first rated heating power.

4. The electric heater according to claim 1, wherein the dimensions of the tolerance PTC heating element approximately correspond to those of the PTC heating elements with the first rated heating power.

5. The electric heater according to claim 1, wherein the tolerance PTC heating element has the same thickness as the PTC heating elements with the first rated heating power.

6. The electric heater according to claim 5, wherein the tolerance PTC heating element has the same length as the PTC heating elements with the first rated heating power.

7. The electric heater according to claim 5, wherein the tolerance PTC heating element has the same width as the PTC heating elements with the first rated heating power.

8. The electric heater according to claim 1, wherein the first rated heating power has a value of between 50 Watts and 100 Watts.

9. The electric heater according to claim 1, wherein the PTC heating elements are held in a common level in positioning frames.

10. The electric heater according to claim 9, wherein each positioning frame comprises openings only for the PTC heating elements with the first and second rated heating powers required in each case.

11. The electric heater according to claim 1, wherein the auxiliary electric heater is designed for voltages lower than 120V.

12. A process comprising the steps of:

a. assembling an electric heater to form a layered structure of a plurality of alternating levels of PTC heating elements and radiator elements, wherein each of the levels with PTC heating elements comprises at least one primary PTC heating element, and wherein all of the primary PTC heating elements have the same, first rated heating power;

b. compensating for departures from an actual heating power of the PTC heating elements of each level by inserting at least one tolerance PTC heating element in the level, the tolerance PTC heating element having a second rated heating power that is lower than the first rated heating power; and c. repeating the assembling and compensating steps to produce a plurality of additional electric heaters, and wherein all of the primary PTC heating elements of all the electric heaters have the same, first rated power and all of the tolerance PTC heating elements of all the electric heaters have the same, second rated power.

13. The process according to claim 12, wherein the correcting step comprises, for each level, at least one of 1) replacing a primary PTC heating element with a tolerance PTC heating element and 2) inserting a tolerance PTC heating element in the level.

14. The process according to claim 12, wherein the primary and tolerance PTC heating elements have essentially have the same dimensions.

* * * * *